United States Patent [19]

Dixon et al.

[11] 4,027,714

[45] June 7, 1977

[54] HINGE STRIP FOR DUAL WALL ACCORDION FOLDING DOOR

[75] Inventors: Guy E. Dixon, Miami; Thomas M. Dixon, Hollywood; Russell I. Geyer, Jr., Miami, all of Fla.

[73] Assignee: Panelfold Doors, Inc., Miami, Fla.

[22] Filed: May 18, 1973

[21] Appl. No.: 361,852

[52] U.S. Cl. ..... 160/84 R; 16/150; 160/231 A

[51] Int. Cl.[2] ..... E06B 3/94

[58] Field of Search ..... 160/84 R, 84 A, 84 V, 160/231 A, 199, 206, 135; 16/150, 167, 162

[56] References Cited

UNITED STATES PATENTS

| | | | |
|---|---|---|---|
| 3,234,996 | 2/1966 | King et al. | 160/231 A X |
| 3,326,268 | 6/1967 | Dixon | 160/231 A |
| 3,348,628 | 10/1967 | Dixon et al. | 160/84 R X |
| 3,708,009 | 1/1973 | Viol et al. | 160/84 V |

FOREIGN PATENTS OR APPLICATIONS

| | | | |
|---|---|---|---|
| 275,767 | 2/1965 | Australia | 160/84 R |
| 901,247 | 7/1962 | United Kingdom | 160/84 R |

*Primary Examiner*—Philip C. Kannan
*Attorney, Agent, or Firm*—Clarence A. O'Brien; Harvey B. Jacobson

[57] ABSTRACT

A hinge strip for a dual wall accordion folding door in the form of a continuous strip of resilient, flexible plastic material, or the like, defining a seal and hinge connecting the edge of four panels together thereby defining the interior hinge for the dual wall accordion folding door. The strip includes a central body adapted to be supported from an overhead track and four flanges projecting from the central body and connected with the panel edges. The central body and flanges may be of many shapes and configurations with a basic form of the strip including a solid central body and equally spaced identical flanges radiating therefrom. Another form of the strip includes a hollow central body and certain of the flanges being interconnected by a flexible web to define a pair of hollow interior areas to retain acoustical isolation of the panels from each other and one wall of the door from the other while at the same time stabilizing and controlling the hinge axes of the panels.

11 Claims, 5 Drawing Figures

HINGE STRIP FOR DUAL WALL ACCORDION FOLDING DOOR

BACKGROUND OF THE INVENTION

1. Field of the Invention

The present invention generally relates to dual wall accordion folding doors and, more particularly, a hinge strip of one-piece construction pivotally connecting the edges of the four panels thereby forming the hinge axis or axes and forming a seal for maintaining the acoustical as well as the other properties of the door.

2. Description of the Prior Art

Acoustical folding doors, including dual wall accordion folding doors, are known in the art. For example, in our prior U.S. Pat. No. 3,348,628, issued Oct. 24, 1967, an acoustical folding door of this type is disclosed. However, the structures which defined the interior hinges for the dual walls of the door used in previous devices of this type utilize a rigid hinge strap to define the hinge axes for the four edges of the panels defining the interior hinge connection of the dual walls with the rigid hinge strap also, in some instances, being used to engage the supporting roller assembly suspended from the overhead track thereby supporting the door. Such hinge arrangements, being of rigid materials, transmit sound vibrations from one wall of the door to the other and also transmit sound vibrations between the door and the overhead track. Also, while the hinge structure disclosed in the aforementioned patent operates effectively, the rigidity and weight of the hardware results in a relatively bulky and high cost construction which, in some installation, are not permissible.

SUMMARY OF THE INVENTION

The present invention has for its primary object the provision of a seal strip of unitary or one-piece construction which interconnects the edges of the four panels defining the interior corners of a dual wall accordion folding acoustical door which maintains the acoustical integrity of the walls of the door and also maintains the other characteristics of the folding door such as air, light and dust integrity.

Another object of the invention is to provide a hinge strip embodying a central body having an adapting structure to enable the strip to be supported directly from a depending shank, rod, screw, or the like, on an overhead track engaging roller or guide assembly thus maintaining the acoustical integrity of the folding door by acoustically isolating it from the overhead track.

Still another object of the invention is to provide a hinge strip in accordance with the preceding objects in which the hinge strip is provided with a central body and four flexible and resilient flanges engaged with the corresponding edges of the panels of the walls of the door.

A further object of the invention is to provide a hinge strip in accordance with the preceding object in which certain of the flanges are interconnected by flexible webs which define hollow spaces or voids to further maintain the acoustical integrity of the door.

A still further object of the invention is to provide a hinge strip defining the interior hinge of a dual wall accordion folding door which is relatively inexpensive to manufacture, easy to assemble, attractive in appearance and effective for stabilizing and controlling the hinge point or hinge axes of the panels.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
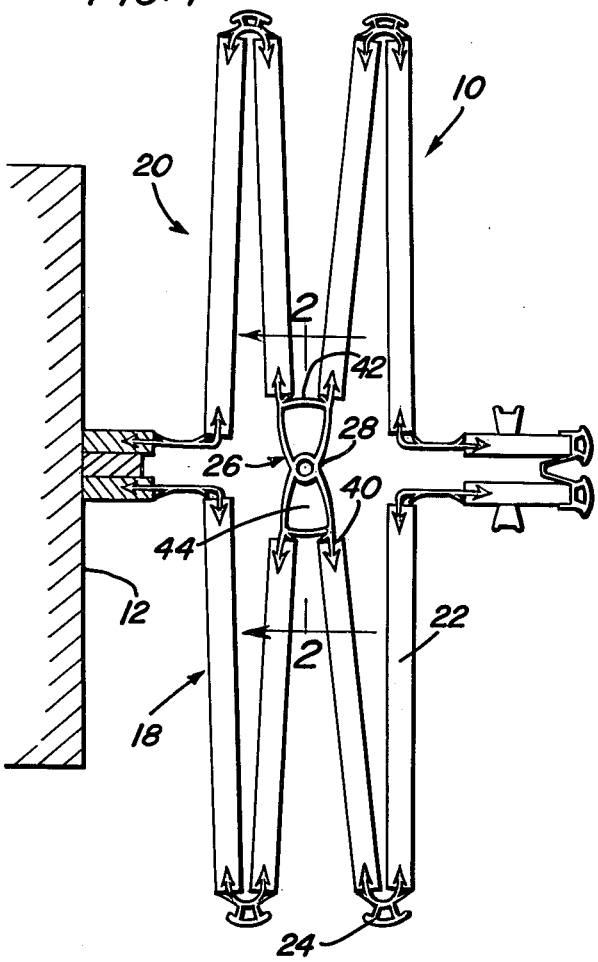
FIG. 1 is a top plan view of a portion of a dual wall accordion folding door with the hinge strip of the present invention incorporated therein illustrating the door in retracted position.
Figure 3:
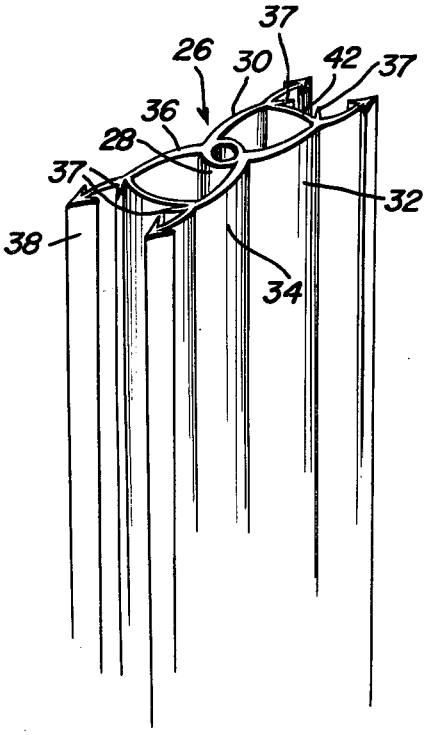
FIG. 3 is a fragmental perspective view of the hinge strip illustrating the association of the components thereof.
Figure 2:
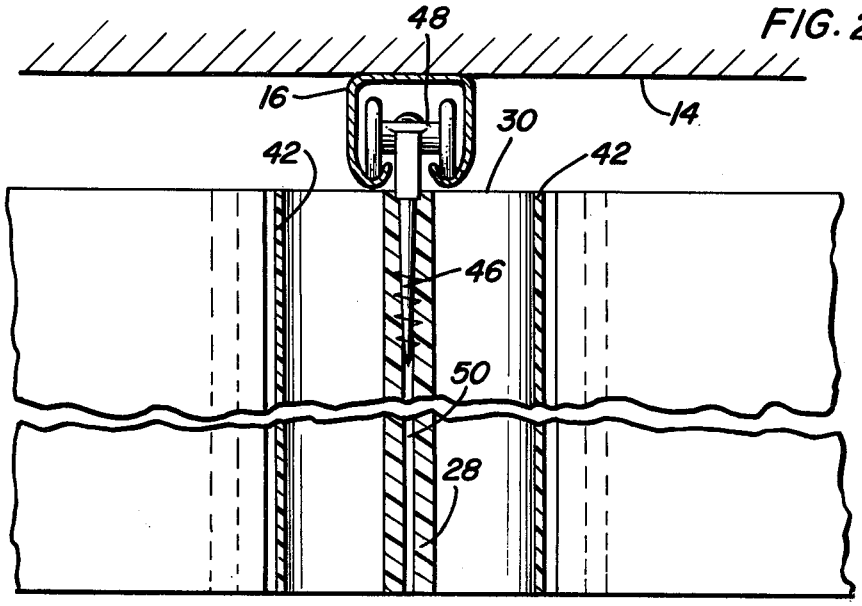
FIG. 2 is a vertical sectional view illustrating a portion of the hinge strip and its association with an overhead supporting track.
Figure 4:
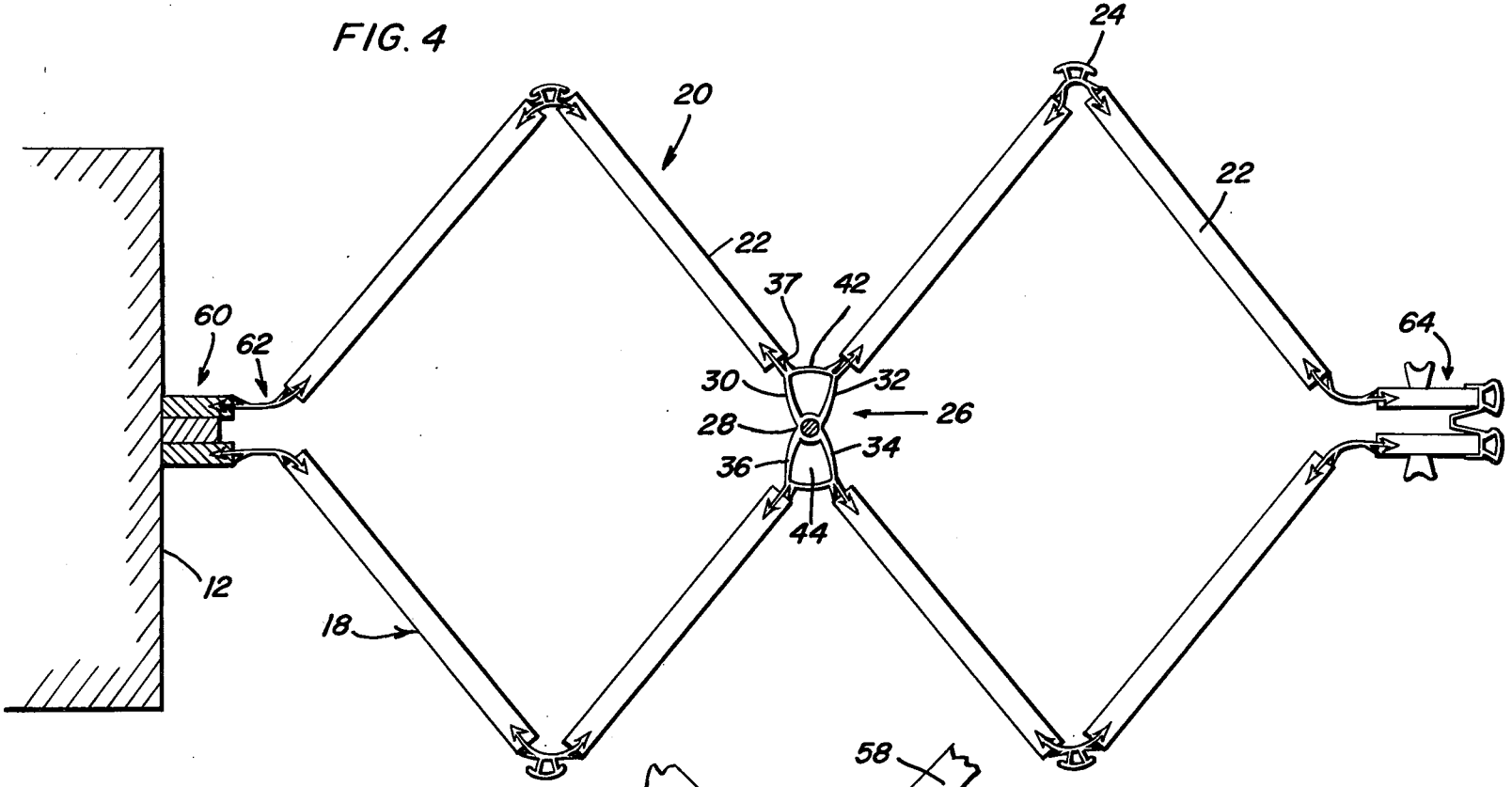
FIG. 4 is a plan view of the door in extended position.

The dual wall accordion folding door assembly is generally designated by reference numeral 10 and is similar to the general arrangement illustrated in prior U.S. Pat. No. 3,348,628, issued Oct. 24, 1967, which arrangement is incorporated herein by reference thereto. The door is incorporated into a building structure defined by vertical members, one of which is designated by numeral 12, and supported from an overhead ceiling 14 by a track 16 with the door being extendible and retractable and foldable generally in the nature of an accordion folding door. The dimensional characteristics of the door 10 may vary depending upon the installational requirements.

The door 10 includes dual walls 18 and 20 with each wall including a plurality of rigid panels 22 constructed of materials, such as wood, particle-board, metal, plastic, or other similar materials having an external finish of desired characteristics. The outside or exterior hinge between the panels 22 is in the form of a hinge strip 24 of any of a variety of constructions such as those disclosed in prior U.S. Pat. Nos. 3,348,628, 2,579,910, 3,131,753, 3,236,289, 3,232,333 and 3,326,268. The interior hinge between the panels 22 is defined by a hinge strip generally designated by the numeral 26 and which is the subject of the present invention as to its specific structure and specific relationship to the panels 22. As illustrated, the hinge strip 26 joins and defines the hinge beween the four panels 22, two of which are in wall 18 and two of which are in the wall 20. The hinge strip 26 is of one-piece or a unitary construction with the material being flexible and resilient and including appropriate memory characteristics, such as a plastic material similar to that used in the seal strip 24. The memory characteristics of the plastic material equalize movement of the panels during extension and retraction thereby enabling the elimination of expensive pantograph linkage normal used to equalize and control movement of the panels.

One form of hinge strip 26 illustrated in FIGS. 1–4 includes an elongated central hollow body 28 with four flanges 30, 32, 34 and 36 projecting therefrom in pairs with the flanges 30 and 32 generally paralleling each other and defining one pair and the flanges 34 and 36 generally paralleling each other and defining a second pair. The flanges taper somewhat in thickness from the central body 28 to the outer edges thereof with the outer edges terminating in a generally V-shaped rib 38 which serves as an anchor for anchoring the outer edge portions of the flanges to the corresponding edges of the panels 22 by virtue of the panels 22 having a groove 40 formed therein corresponding in shape to the rib 38 and adjacent portion of the flange on the strip thereby anchoring the flanges on the strip 26 to the edges of the panels 22.

Interconnecting the flanges 30 and 32 and flanges 34 and 36 in spaced relation to the central body 28 is a web 42 which is flexible and define voids or hollow spaces 44 which enhance the acoustical isolation properties of the strip 26 with the web 42 also serving to stabilize the flanges between which the web extends. Each of the flanges includes a narrow flexible flap 37 extending laterally therefrom outwardly of the web 42 for engagement with the exposed corner of the panel 22 to which the flange is connected. As illustrated, the strip 26 is symmetrical on both sides of intersecting vertical planes passing through the center of the strip.

The central body 28 of the strip is adapted to receive and be supported by the shank 46 of a roller assembly 48 that is supported by the overhead track 16. In the embodiment of FIGS. 1–4, the shank 46 is provided with peripheral ridges or screw threads thereon. The central body 28 includes a longitudinal passageway or bore 50 therethrough which is of less diameter than the screw threaded shank 46 so that the supporting roller assembly 48 may be connected to the strip 26 by merely threading the threaded shank 46 into the bore 50 in the central body 28. Other arrangements may be provided for correcting the central body 28 to an overhead support depending upon the type of roller assembly or glide assembly to be employed. If desired, bonding agents or the like may be used to more securely anchor the supporting assembly to the central body 28 so that the center of the juncture between the four panels 22 will generally coincide with the supporting axis for the roller assembly 48 whereby forces exerted onto the roller assembly through the hinge strip 26 will be substantially evenly divided to prevent any tendency of the roller to cant, twist or bind.

Figure 5:
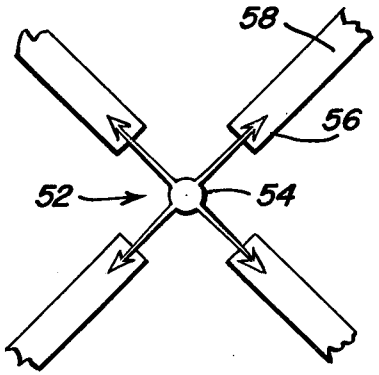
FIG. 5 is a fragmental plan view of a simplified form of hinge strip.

FIG. 5 illustrates a simplified version of the hinge strip illustrating the basic idea and also illustrating that the shape and configuration of the hinge strips may be varied both as to the shape and structure of the central body and the configuration and dimensional characteristics of the flanges. In this embodiment of the invention, the hinge strip is generally designated by reference numeral 52 and includes a central body 54 which is illustrated as being of solid construction and cylindrical in configuration but it is pointed out that any suitable shape and configuration may be employed. Radiating from the central body 54 is a plurality of flanges 56 which are received in and anchored in grooves formed in the edges of the panels 58. The flexibility of the material from which the hinge strip is constructed enables pivotal movement of the panels 58 during extension and retraction of the door.

The hinge strip may be constructed of extruded vinyl with the dynamic tension characteristics of the material and the memory characteristics thereof serving to retain the panels in a generally symmetrical arrangement with the movement of the panels being equal throughout the door without requiring the use of pantograph linkages or other control means which are relatively expensive, cumbersome and heavy.

Where the door 10 is attached to the opening 12, a jamb structure generally designated by numeral 60 is employed with a hinge strip 62 connecting the side portions of the jamb to the first panel 22 with the hinge strip employed being as illustrated or being of any suitable construction such as the strips shown in the prior patents mentioned previously.

Each of the hinge strips may be provided with flaps to conceal the outside corner edges of the panels, jamb or end post which is generally designated by numeral 64.

With the hinge strip 26 or 52 installed, the hinge axis or axes for the four panels which define the interior hinge will be stabilized but the hinge point or axis for each panel will not be rigidly oriented which facilitates easier and smoother opening and closing of the door 10. The appearance characteristics of the hinge strip may be such that they will blend with, contrast with, or otherwise match the appearance characteristics of the exterior surfaces of the adjacent panels thereby providing an attractive as well as utilitarian hinge strip. Any suitable device may be employed for anchoring the hinge strip in relation to the panels 22 including bonding agents, mechanical fastening devices, and the like. Also, the number of panels and hinge strips employed may be varied so that the panels will be properly oriented when the door is extended to closed position and retracted to open position. As illustrated, the hollow spaces 44 and the flexible and resilient characteristics of the plastic material from which the strip is constructed will maintain the acoustical integrity of the door wall 18 and the door wall 20 inasmuch as sound vibrations will be attenuated and isolated to only one wall 18 or 20 and will not be transmitted to the other wall nor will vibrations be transmitted to or from the overhead track. By varying the tapering characteristics of the flanges, the hinge point or hinge axis may be varied so that the hinge strip will have the appropriate characteristics of shape and strength. Also, the specific construction and configuration of the ribs on the edges of the flanges may be varied and the manner of attaching the flanges to the edges of the panels may be varied.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An accordion folding door including dual walls, each defined by a plurality of panels having edges pivotally connected together, means pivotally connecting certain adjacent panels of one wall to corresponding adjacent panels in the other wall thereby defining an inner hinge means connecting four panels together, said hinge means comprising a vertically continuous strip of material including a central body and four radiating flanges, said flanges being connected with the edges of the four panels, said strip and flanges constructed of resilient flexible material to enable relative pivotal movement of the panels and acoustically isolate the panels from each other and the walls of the dual wall door from each other, said flanges being oriented in adjacent pairs, a flexible web interconnecting the flanges of each pair in spaced relation to the central body thereby defining a vertically continuous void space between the pair of flanges for maintaining acoustical integrity of the strip.

2. The structure as defined in claim 1 wherein each flange is provided with a flap thereon extending toward and engaging an exposed corner of the adjacent panel.

3. The structure as defined in claim 1 wherein each of the flanges is provided with an enlargement on the free edge thereof for reception in a correspondingly shaped groove in the edge of a panel for securing the flange to the panel.

4. The structure as defined in claim 1 wherein said central body is a solid member adapted to be supported from an overhead support.

5. The structure as defined in claim 1 together with an overhead track, support means movable on the overhead track and including a depending shank, said central body of the strip including means connected with the depending shank.

6. The structure as defined in claim 5 wherein said means on the central body includes a tubular bore to receive said shank.

7. The structure as defined in claim 6 wherein said bore in the central body is of less cross-sectional area than the shank, said shank being in the form of a screw member screw threaded into and anchored in said bore thereby supporting the strip and panels from the track.

8. A hinge strip for use as the inner hinge on a dual wall accordion folding door comprising an elongated strip of unitary construction of resilient, flexible material, said strip including a central body, a plurality of radially extending flexible flanges on said body with the flanges adapted to be connected with the edges of adjacent panels in the walls of the door to pivotally connect the panels together and to pivotally connect the walls of the door together, said flanges being arranged in pairs, a flexible web interconnecting the flanges in each pair in spaced relation to the central body to provide vertically continuous void spaces in the strip for maintaining acoustical integrity.

9. The hinge strip as defined in claim 8 wherein said central body is provided with a hollow bore.

10. The hinge strip as defined in claim 8 wherein said central body is transversely solid.

11. The hinge strip as defined in claim 8 wherein each flange is provided with a flap thereon extending toward and adapted to engage an exposed corner of a panel.

* * * * *